United States Patent [19]

Luke

[11] Patent Number: 4,718,436

[45] Date of Patent: Jan. 12, 1988

[54] SMOKING ARTICLES

[75] Inventor: John A. Luke, Eastleigh, England

[73] Assignee: British-American Tobacco Company, Ltd., London, England

[21] Appl. No.: 945,722

[22] Filed: Dec. 22, 1986

[51] Int. Cl.[4] ..... A24D 3/04

[52] U.S. Cl. ..... 131/336; 131/361

[58] Field of Search ..... 131/336, 361

[56] References Cited

U.S. PATENT DOCUMENTS 4,587,982 5/1986 Adams et al. ..... 131/336

4,608,999 9/1986 Johnson ..... 131/336

*Primary Examiner*—V. Millin

*Attorney, Agent, or Firm*—Charles G. Lamb

[57] ABSTRACT

A cigarette comprises a filter element having an air-permeable surface and a tobacco rod, the filter element and the tobacco rod being interattached by an air-impermeable tipping wrapper. The tipping wrapper is attached to, but spaced from, the underlying peripheral surfaces of the tobacco rod and the filter element at first zones extending from the upstream edge of the wrapper across the rod/element juncture and is unattached and spaced from the peripheral surfaces at second zones circumferentially intermediate the first zones. There are thus provided ventilation air inlet ducts through which air is able to enter the filter element without the necessity for tipping wrapper perforations.

10 Claims, 2 Drawing Figures

SMOKING ARTICLES

This invention relates to smoking articles comprising ventilated mouthpieces.

A commonly established practice of the tobacco industry is to provide for the ingress of ventilation air into the filter tips of filter tipped cigarettes by the use of macro or micro performations in the tipping wrappers, such perforations being made mechanically, electrostatically or by laser beam.

A significant determinant of the degree of ventilation of a filter tipped cigarette which is ventilated by way of tipping perforations is the pressure drop of which the air is subject in the passage thereof through the perforatons. The pressure drop value is dependent upon the size of the perforations and the number of perforations per unit area. It is a well-established practice to produce the perforations during the cigarette manufacturing process and, in order to ensure that the specified ventilation value is consistently attained, the cigarettes are continually tested and the perforating apparatus appropriately adjusted when there is detected a drift away from the specified ventilation value. These test and feedbck procedures are complex and should there be a failure of them, even if only of short duration, the result, at the high speed of operation of modern cigarette machinery, may be the production of a large number of faulty cigarettes.

Proposals have been made for providing for the ingress of ventilation air to tipped cigarettes other than by resort to tipping wrapper perforations.

In European Patent Specification No. 059 040 there are described filter tipped cigarettes in which the tipping wrapper is provided at its inner side with ventilation air grooves extending from the end of the wrapper remote the mouth end of the filter tip. The grooves are formed by an embossing process and for this reason the tipping wrapper material is very thick, a thickness of 0.8 mm being preferred. The use of such thick material represents a significant departure from orthodox practice since normal tipping paper is of a thickness which is measured in tens of micrometers, 40 micrometers being a typical value. When a normal tipping paper is used it is wrapped about the filter tip and sealed by way of a longitudinal lap seam. Such a seam is not practicable with 0.8mm thick material and Specification No. 059 040 teaches the provision of a form of scarf seam.

In U.S. Pat. No. 3,608,561 there is disclosed filter extender means for optional attachment to a cigarette by the smoker of a filter. The extender means takes the form of a tubular housing, the filter being contained within the housing at one end thereof. An end of a cigarette to which the filter is to be attached is inserted into the housing at the other end thereof and is pushed into the housing until the end of the cigarette abuts the filter. The housing is provided with inner, longitudinally extending ridges which, where they contact the cigarette, compress the cigarette and thereby create channels adjacent the ridges. According to the teaching of U.S. Pat. No. 3,608,561, although these channels are minute, they may serve as air channels. Clearly, such filter extender means do not have application to commercial cigarette manufacture.

In United Kingdom Patent Specification No. 917,211 filter tipped cigarettes are disclosed in which a series of circumferentially extending slits are formed in the cigarette paper so as to extend about the cigarette rod. Portions of the tipping wrapper which overlie the slits are unsecured to the cigarette rod, thus to provide for airflow access via the slits to the interior of the cigarette rod. However, the presence of the slits would weaken the cigarette paper and would thus give rise to the likelihood of breakage of the cigarette rod.

In United Kingdom Patent Specification No. 2,088,193 there are disclosed cigarettes comprising a porous filter plug wrapped in a non-porous wrapper and a plurality of air channels extending longitudinally therealong a distance less than that of the plug. An air permeable tipping wrapper provides means for the ingress of ventilating air.

It is an object of the present invention to provide improved means for the ingress of ventilation air into mouthpieces of smoking articles other than by using tipping wrapper perforations. It is a further object of the present invention to provide such means without the necessity of a more than minimal departure from currently orthodox cigarette manufacturing practice.

The present invention provides a smoking article comprising a smoking material rod, a mouthpiece and a tipping wrapper, said wrapper being attached to but spaced from the underlying peripheral surfaces of said rod and said mouthpiece at first, lengthwise extending, circumferentially spaced zones by spacing means, and said wrapper being unattached to, and being spaced from, said peripheral surfaces at second zones intermediate said first zones to provide ventilation ducts each lengthwise extending from a first, open end at said rod to a second end at said mouthpiece.

As used herein, the term "mouthpiece" refers to an element incorporated in a smoking article at the mouth end thereof, which element, or a portion thereof, may take the form of a filter.

Advantageously, the spacing means can be of hot-melt adhesive material, the adhesive material suitably extending substantially wholly over the inner surface of the wrapper except at the second zones.

Advantageously, the second ends of the ventilation ducts are close to the juncture of the smoking material rod and the mouthpiece, and the ducts, at second end regions thereof, are in air-flow communication with the interior of the mouthpiece.

In alternative constructions the ventilation ducts extend to and are open at the mouth end of the mouthpiece.

Preferably, the tipping wrapper is substantially air impermeable.

In order that the present invention is clearly understood and readily carried into effect, reference will now be made, by way of example, to the accompanying drawings, in which.

Figure 1:
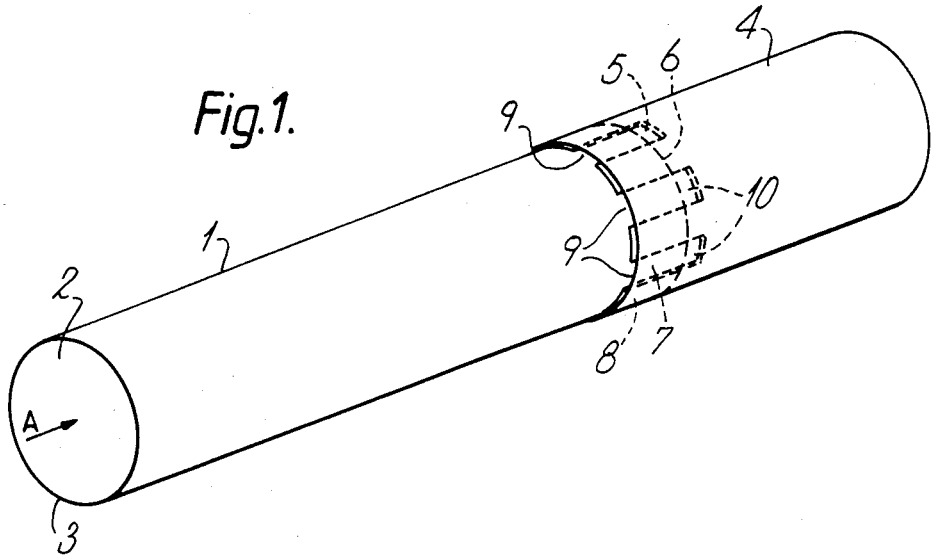
FIG. 1 shows a perspective view of a filter tipped cigarette.
Figure 2:
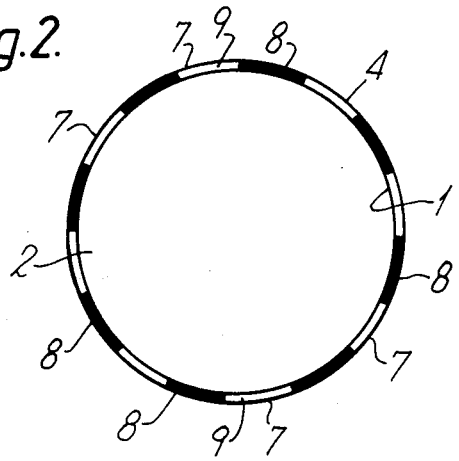
FIG. 2 shows an end view of the cigarette of FIG. 1 looking in the direction of arrow A.

The cigarette shown in the drawings comprises a cigarette rod 1, of cut tobacco 2 wrapped in a cigarette paper wrapper 3, and an air impermeable paper tipping wrapper 4 which serves to interattach the cigarette rod 1 and a cylindrical filter plug 5. Reference numeral 6 designates the line of abutment of the rod 1 and the plug 5.

The tipping wrapper 4 is adhered to the peripheral surface of the filter plug 5 and to an end portion of the peripheral surface of the rod 1 over the whole overlying inner surface of the wrapper 4 except for rectangular areas 7 in which no adhesive has been applied. The areas 7, which as shown are of rectangular configuration, extend from the edge of the wrapper 4 which overlies the rod 1 to a location overlying the plug 5. At the areas 7 the wrapper 4 is spaced from the peripheral surfaces of the rod 1 and the plug 5 by the thickness of the adhesive in areas 8 intermediate the areas 7. There are thus provided ventilation ducts 9 which, during the smoking of the cigarette, serve to conduct ventilating air to the periphery of the filter plug 5 at comparatively large areas 10 thereof. The air enters the filter plug 5 at the areas 10 and flows with the smoke drawn from the rod 1 to the mouth end of the plug 5.

In order to permit the ingress of air at the areas 10 the filter plug 5 may comprise a highly air-permeable plugwrap. An alternative is for the plug 5 to be of a self-sustaining character with a highly air-permeable peripheral surface.

As an alternative to the spacing means being provided by the application of fluent material such as an adhesive material to the inner surface of the tipping wrapper, the spacing means may be provided by a further wrapper beneath the tipping wrapper, in which case the second zones are provided by portions cut out from the further wrapper.

What is claimed is:

1. A smoking article comprising a smoking material rod, a mouthpiece in abutment with one end of the smoking material rod and having an air permeable peripheral surface and a tipping wrapper surrounding the mouthpiece and circumferentially overlapping the end of the smoking material rod in abutment with said mouthpiece, said wrapper being attached to but radially spaced from the underlying peripheral surfaces of said rod and said mouthpiece at first lengthwise extending, circumferentially spaced zones by spacing means, and said wrapper being unattached to and being spaced from said peripheral surfaces at second zones intermediate said first zones to provide ventilation air ducts each lengthwise extending from a first open end at said rod to a second end at the peripheral surface of said mouthpiece to provide for the flow of ventilation air into said second zones through said first open ends and from said second zones through said second open ends into said mouthpiece through the permeable peripheral surface of said mouthpiece.

2. A smoking article as claimed in claim 1, wherein the second ends of said ducts are close to the juncture of said rod and said mouthpiece.

3. A smoking article as claimed in claim 2, wherein said ducts at second end regions thereof are in air-flow communication with the interior of said mouthpiece.

4. A smoking article as claimed in claim 3, wherein said mouthpiece is a self-sustaining filter plug having a highly air-permeable peripheral surface.

5. A smoking article as claimed in claim 3, wherein said mouthpiece is a filter plug wrapped in a highly air-permeable plugwrap.

6. A smoking article as claimed in claim 1, wherein said ducts extend to, or substantially to, the mouth end of said mouthpiece.

7. A smoking article as claimed in claim 6, wherein said second ends are open at said mouthpiece end.

8. A smoking article as claimed in claim 1, wherein said tipping wrapper is substantially air-impermeable.

9. A smoking article as claimed in claim 1, wherein said spacing means is comprised of adhesive material.

10. A smoking article as claimed in claim 1, wherein said spacing means is comprised of a further wrapper beneath said tipping wrapper.

* * * * *